US008201594B2

(12) United States Patent
Martin

(10) Patent No.: US 8,201,594 B2
(45) Date of Patent: Jun. 19, 2012

(54) SYSTEM AND METHOD FOR FILLING CONTAINERS

(75) Inventor: Carl Martin, Millersburg, PA (US)

(73) Assignee: Advanced Scientifics, Inc., Millersburg, PA (US)

( * ) Notice: Subject to any disclaimer, the term of this patent is extended or adjusted under 35 U.S.C. 154(b) by 1044 days.

(21) Appl. No.: 12/136,412

(22) Filed: Jun. 10, 2008

(65) Prior Publication Data

US 2008/0302443 A1 Dec. 11, 2008

Related U.S. Application Data

(63) Continuation-in-part of application No. 11/694,365, filed on Mar. 30, 2007, now Pat. No. 7,530,374.

(60) Provisional application No. 60/803,403, filed on May 30, 2006.

(51) Int. Cl.
*B65B 3/04* (2006.01)

(52) U.S. Cl. ..... 141/193; 141/90; 141/263; 141/346; 141/383; 141/390; 141/392; 222/153.04; 222/153.13; 222/153.14; 53/381.4; 53/468

(58) Field of Classification Search ..... 141/85, 141/89–91, 146–147, 192, 193, 263, 264, 141/311 R, 332, 333, 346–347, 383, 384, 141/390, 392; 222/74, 153.01, 153.04, 153.13, 222/153.14; 137/383, 798; 53/381.4, 468
See application file for complete search history.

(56) References Cited

U.S. PATENT DOCUMENTS

| | | | | |
|---|---|---|---|---|
| 3,926,229 | A * | 12/1975 | Scholle | 141/1 |
| 4,212,414 | A * | 7/1980 | Beyens | 222/148 |
| 4,350,187 | A * | 9/1982 | Trusselle et al. | 141/90 |
| 4,452,030 | A * | 6/1984 | Inada | 53/426 |
| 4,460,025 | A * | 7/1984 | Scholle et al. | 141/1 |
| 4,494,363 | A * | 1/1985 | Rica et al. | 53/426 |
| 4,524,563 | A * | 6/1985 | Sassi | 53/426 |
| 4,942,716 | A * | 7/1990 | Anderson | 53/426 |
| 5,335,479 | A * | 8/1994 | Lemke et al. | 53/426 |
| 5,343,907 | A * | 9/1994 | Wagner | 141/89 |
| 5,524,683 | A * | 6/1996 | Mueller | 141/129 |
| 6,070,622 | A * | 6/2000 | Rutter | 141/90 |
| 6,230,472 | B1 * | 5/2001 | Stahlecker | 53/426 |
| 6,256,964 | B1 * | 7/2001 | Drevfors | 53/426 |
| 6,330,780 | B1 * | 12/2001 | Shipway | 53/426 |
| 6,352,089 | B1 * | 3/2002 | Breton | 141/89 |
| 6,941,986 | B2 * | 9/2005 | Hoeppner | 141/329 |

* cited by examiner

*Primary Examiner* — Gregory Huson
*Assistant Examiner* — Nicolas A Arnett
(74) *Attorney, Agent, or Firm* — McNees Wallace & Nurick LLC

(57) ABSTRACT

A system (10) and method for substantially automatically aseptically or non-aseptically filling a container with a fluid. The transfer of fluid occurs via a movable nozzle mechanism (20) substantially automatically inserted into a side opening (32) in a connector (12) attached to the container. More specifically, the side opening (32) in the connector (12) is exposed, the nozzle mechanism (20) is moved into the side opening (32), the fluid is transferred into the container via the nozzle mechanism (20) and the connector (12), the nozzle mechanism (20) is removed from the side opening (32) in the connector (12), and the side opening (32) in the connector (12) is closed. The aseptic transfer of fluid includes a substantially automatic sterilization procedure accomplished by both spray and contact components (54,56).

9 Claims, 13 Drawing Sheets

SYSTEM AND METHOD FOR FILLING CONTAINERS

RELATED APPLICATIONS

The present continuation-in-part patent application is related to and claims priority benefit of a U.S. non-provisional patent application of the same title, Ser. No. 11/694,365, filed Mar. 30, 2007 now U.S. Pat No. 7,530,374, which is related to and claims priority benefit of an earlier-filed U.S. provisional patent application of the same title, Ser. No. 60/803,403, filed May 30, 2006. The identified earlier-filed patent applications are hereby incorporated by reference herein.

BACKGROUND OF THE INVENTION

1. Field of the Invention

The present invention relates broadly to systems and methods for filling containers. More specifically, the present invention concerns a system and method for substantially automatically aseptically or non-aseptically filling a container with a fluid, wherein the transfer of fluid occurs via a movable nozzle mechanism substantially automatically inserted into a side opening in a connector attached to the container, and wherein the aseptic transfer of fluid includes a substantially automatic sterilization procedure.

2. Background of the Invention

It is often desirable to quickly and efficiently fill containers with fluids. To that end, systems are available for transferring liquids from large capacity sterile or otherwise controlled environments to smaller containers for sale and consumption. These systems generally involve establishing and maintaining the same controlled environment within a transfer conduit extending between the source and the container.

Unfortunately, these systems suffer from a number of disadvantages with regard to maintaining the controlled environment within the transfer conduit while accomplishing the transfer as quickly and efficiently as possible. For example, some such systems utilize disposable, single-use tubing as the transfer conduit, which requires that the tubing be replaced before each transfer. Other such systems utilize filling chambers lined with disposable liners which must be properly positioned, sealed, and validated prior to filling and then removed following filling. Still other such systems rely on undesirably complex and expensive valve mechanisms at one or both ends of the conduit, or transfer the fluid in such an uncontrolled manner as to result in significant waste and require a separate cleaning step prior to completion.

Due to these and other problems and limitations of the prior art, a need exists for an improved system and method for quickly and efficiently filling containers with fluids.

SUMMARY OF THE INVENTION

The present invention overcomes the above-discussed and other problems and limitations of the prior art by providing an improved system and method for quickly and efficiently filling containers with a fluids.

In one embodiment, the system of the present invention comprises a connector attached to the container and including a fitting having a side opening, and a filling machine including a nozzle mechanism which is movable to enter the side opening and transfer the fluid through the connector and into the container. The fitting may include an upper fitting portion and a lower fitting portion which cooperate to expose the side opening for filling the container, and which cooperate to block the side opening once the container is filled. The fitting may further include a top surface which is puncturable or otherwise openable to access the fluid within the filled container.

In one embodiment, the connector includes a locking mechanism positioned over the fitting. The locking mechanism may include one or more external side channels for cooperating with a cap.

In one embodiment, the filling machine further includes a removal mechanism for removing the locking mechanism from the fitting to expose the side opening for filling the container, and for replacing the locking mechanism once the container is filled.

In one embodiment, the filling machine further includes a filling chamber including an outer body including a bottom opening for receiving at least a portion of the connector, and a side opening for receiving the nozzle mechanism, and an inner body slidably received within the outer body and movable between a first position in which the inner body blocks the side opening in the outer body, and a second position in which the inner body does not block the side opening in the outer body. In this embodiment, the nozzle mechanism includes a shaft movable between a first position in which the shaft extends through the side opening in the outer body of the filling chamber and into the side opening in the connector, and a second position in which the shaft is retracted and the side opening in the outer body of the filling chamber is blocked by the inner body.

In one embodiment the filling machine includes a sterilization mechanism for sterilizing the connector and the filling chamber, the sterilization mechanism including a sprayer component for spraying a sterilizing liquid into the filling chamber, an evacuation component for evacuating an airborne portion of the sterilizing liquid prior to filling the container, and a contact component for applying the sterilizing liquid directly to at least a portion of the connector. The contact component may also apply the sterilizing liquid directly to at least a portion of the nozzle mechanism. The sprayer component may receive the sterilizing liquid from a reservoir, and the contact component may wick the sterilizing liquid from the reservoir.

From the present disclosure, it will be appreciated by one with ordinary skill in the art that the present invention provides a number of advantages over the prior art, including, for example, that close cooperation between the nozzle mechanism and connector advantageously allows for a more controlled transfer of fluid to the container, which eliminates waste and the need for a separate cleaning step prior to completion. Furthermore, the connector and filling chamber are sterilized at the beginning of every fill cycle, there is a complete sterilization rinse cycle after a pre-set number of fills, and measurable and measured sterilization of all moving components is allowed for.

These and other features of the present invention are described more fully in the section titled DETAILED DESCRIPTION OF THE INVENTION, set forth below.

BRIEF DESCRIPTION OF THE DRAWING FIGURES

The present invention is herein described with reference to the following drawing figures, which are not necessarily to scale:

DETAILED DESCRIPTION OF THE INVENTION

Figure 1:
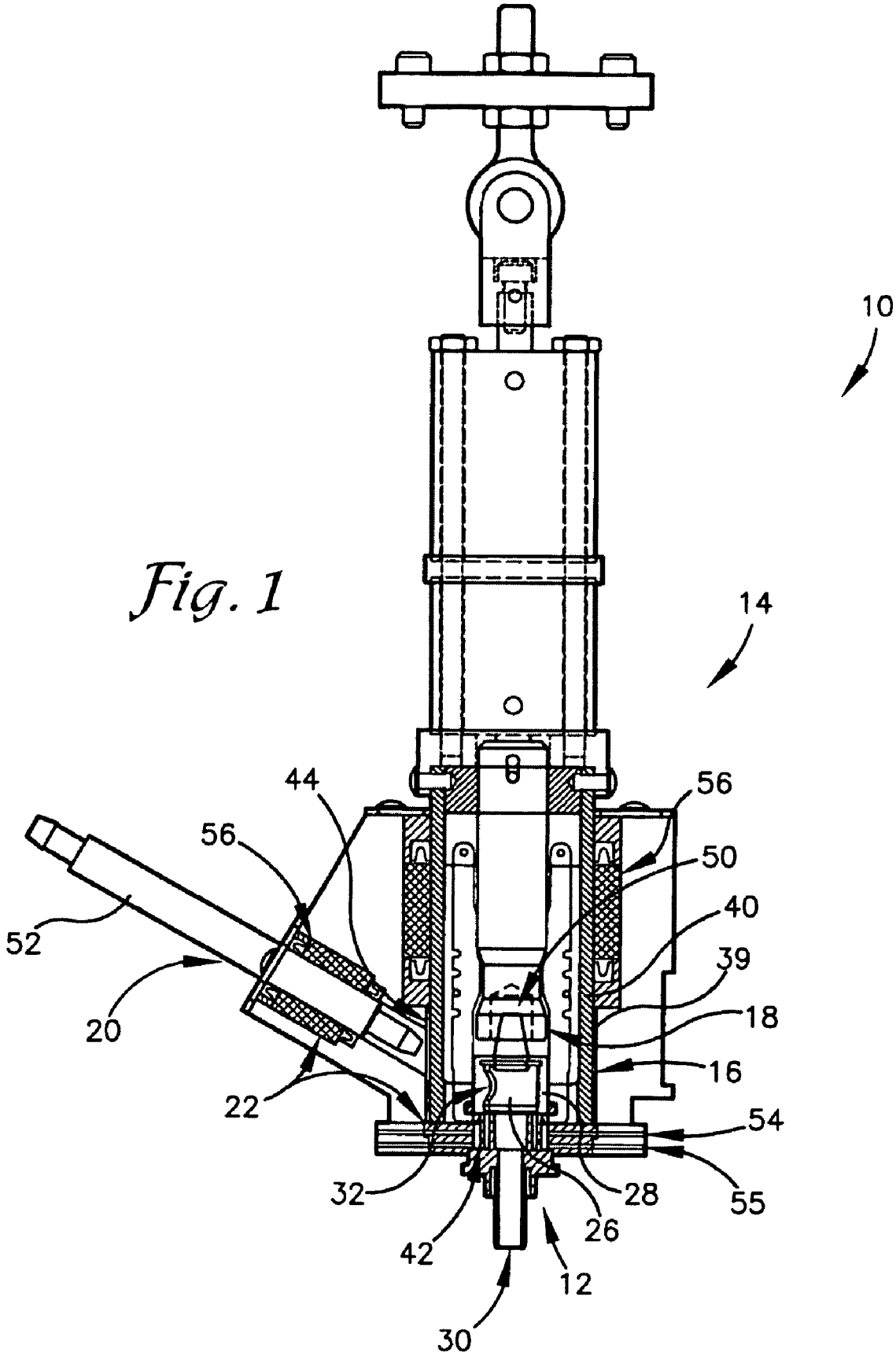
FIG. 1 is a sectional elevation view of an embodiment of the system of the present invention.

With reference to the drawing figures, a system and method is described, shown, and other disclosed herein in accordance with one or more preferred embodiments of the present invention. Broadly, the system and method allow for substantially automatically aseptically or non-aseptically filling a container with a fluid. In various exemplary applications, the container may be a bag, syringe, or cartridge, and may have a capacity of approximately between 25 milliliters and 10 liters, and the fluid may be a liquid, semi-liquid, gel, paste, powder, or other flowable form of material.

Whether a particular application requires aseptic or non-aseptic filling may depend on such factors as the nature of the fluid and the purpose for which the fluid will be used. For example, the present invention may be used to aseptically fill bags with biological or chemical reagents, medical products, or food products, or to non-aseptically fill bags with inks, cleaning products, or cosmetic products. For aseptic filling, the system 10 may be located within an enclosed and controlled space, such as, for example, a class 100 laminar flow hood. For non-aseptic filling, it may still be necessary or desirable to establish and maintain a particular filling environment so as to avoid introducing contaminants into the fluid, and the present invention allows for doing so.

Referring to FIG. 1, an embodiment of the system 10 broadly comprises a connector 12 and a filling machine 14, with the filling machine including a filling chamber 16; a removal mechanism 18; a nozzle mechanism 20; and a sterilization mechanism 22.

Figure 9:
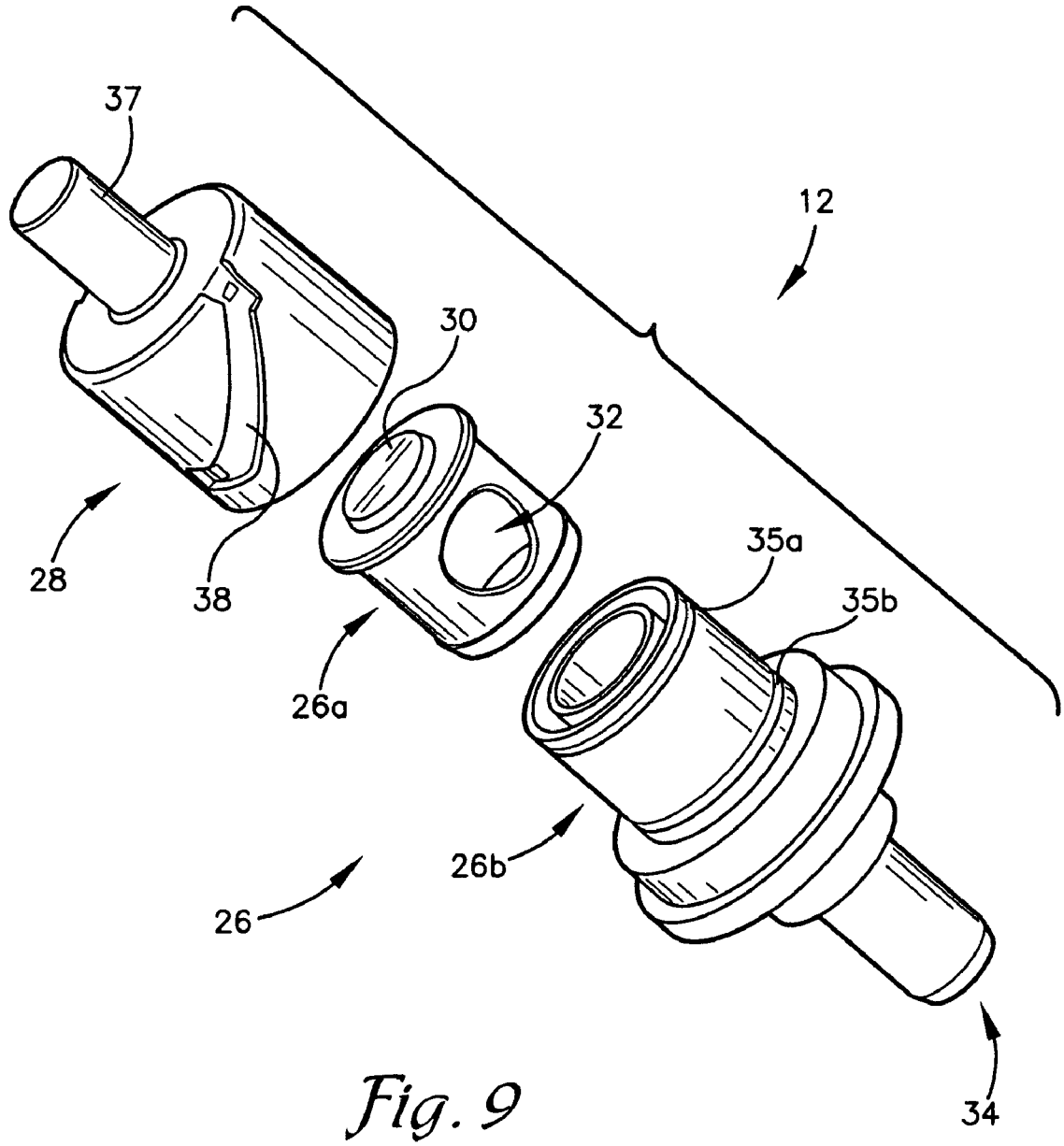
FIG. 9 is an exploded first perspective view of an embodiment of a connector portion of the system, wherein, in use, the connector is attached to a container.
Figure 10:
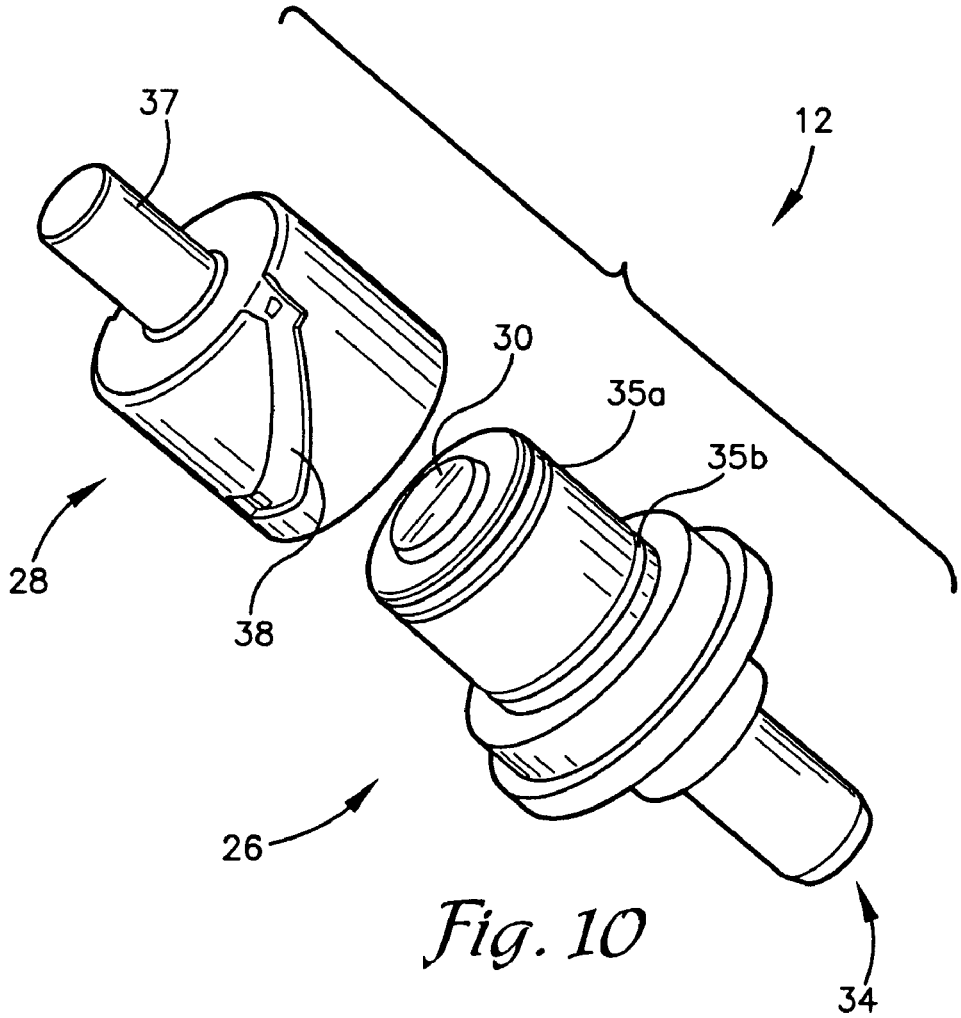
FIG. 10 is an exploded second perspective view of the connector of FIG. 9.
Figure 11:
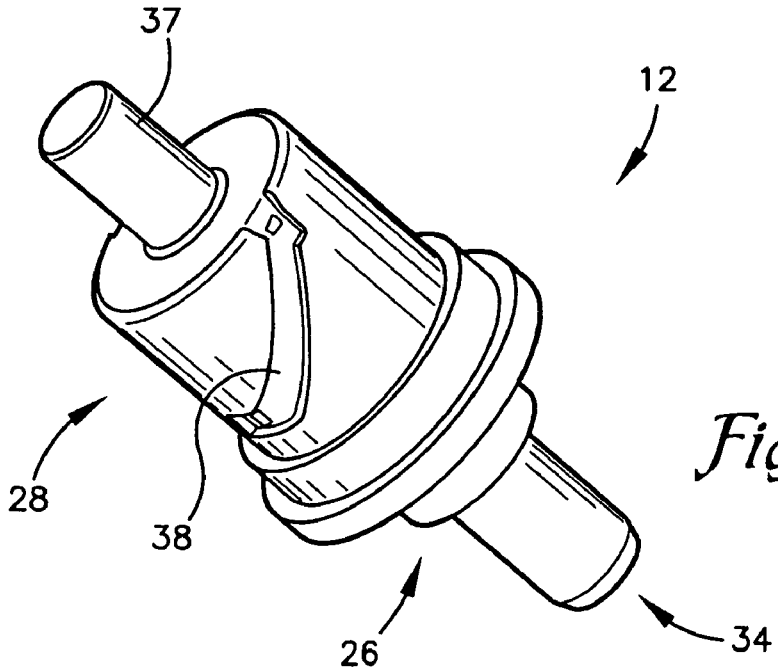
FIG. 11 is a third perspective view of the connector of FIG. 9.

Referring to FIGS. 9-11, the connector 12 provides an interface between the container and the filling machine 14. The connector 12 includes a fitting 26 and a locking mechanism 28. The fitting 26 includes an upper fitting portion 26*a* and a lower fitting portion 26*b*. The upper fitting portion 26*a* includes a top surface 30 and an side opening, or port 32, and may be constructed from any suitable material or combination of materials, including, for example, thermoplastic elastomer (TPE) material. The lower fitting portion 26*b* includes a lower opening 34 and first and second detent structures 35*a*,35*b*. Prior to filling, only a lower part of the upper fitting portion 26*a* is received within, or otherwise cooperates with, an upper part of the lower fitting portion 26*b*, and a fluid pathway extends through the connector 12 between the side opening 32 and the lower opening 34. Following filling, substantially the entire upper fitting portion 26*a* is received within, or otherwise cooperates with, the lower fitting portion 26*b*, as seen in FIG. 10, such that the side opening 32 is closed and only the top surface 30 of the upper fitting portion 26*a* is accessible. More specifically, the side opening 32 allows the fluid to flow from the filling machine 14 into the fitting 26 during filling, and the lower opening 34 allows the fluid to flow into and out of the container during filling and subsequent use, respectively. Thus, when it is desired to fill the container, the fluid is introduced at the side opening 32, flows through the pathway, and exits from the lower opening 34 into the container; and when it is desired to use the fluid, the fluid leaves the container and enters the lower opening 34, flows through the pathway, and exits a hole made in the top surface 30 of the upper fitting portion 26*a* (as described below).

The locking mechanism 28 prevents exposure of the fluid prior to use. The locking mechanism 28 presents a top projection 37, one or more external side channels 38, and one or more internal detent structures (not shown) which correspond to and cooperate with the first and second external detent structures 35*a*,35*b* of the fitting 26. Prior to filling, the detent structure of the locking mechanism 28 is engaged with the first, or uppermost, detent structure 35*a* of the fitting 26. During filling, the locking mechanism 28 is removed in order to facilitate access to the side opening 32 in the fitting 26. Following filling, the locking mechanism 28 is pushed fully down onto the fitting 26 such that the upper fitting portion 26*a* is pushed fully into the lower fitting portion 26*b*, as described above, and such that the detent structure of the locking mechanism 28 engages the second detent structure 35*b* of the fitting 26, thereby securing the connector 12 until ready for use. In one embodiment, the locking mechanism 28 includes two internal detent structures (not shown) which, when the locking mechanism 28 is pushed fully down upon the fitting 26, each engage a respective one of the first and second detent structures 35*a*,35*b* of the fitting 26, thereby providing twice the engagement.

Prior to use, the top projection 37 is removed, such as by breaking or cutting, thereby exposing the top surface 30 of the upper fitting portion 26*a*, and a cap (not shown) is fitted over the locking mechanism 28. The cap presents internal guide projections, an outlet, and an internal spike. The guide projections of the cap are received and move within the channels 38 of the locking mechanism 28 such that at a first uppermost channel location the spike within the cap is furthest from the top surface 30 of the upper fitting portion 26*a*, and at a second lowermost location the spike penetrates the top surface 30 to create an opening through which the liquid can exit.

Referring again to FIG. 1, the filling machine 14 allows for aseptically or non-aseptically filling the container via the above-described connector 12. As mentioned, the filling machine includes the filling chamber 16; the removal mechanism 18; the nozzle mechanism 20; and the sterilization mechanism 22.

The filling chamber 16 establishes and maintains a substantially enclosed or enclosable filling environment. The filling chamber 16 includes a stationary outer body 39 and a movable inner body 40, wherein the inner body 40 is slidably received within, or otherwise cooperates with, the outer body 39. The outer body 39 presents a lower opening 42 for closely receiving at least a portion of the connector 12 into the filling environment, and a side opening 44 for receiving the nozzle mechanism 20 into the filling environment. The inner body 40 cooperates closely with the outer body 39 and presents an opening corresponding to the lower opening 42 but does not present an opening corresponding to the side opening 44, such that when the inner body 40 is in a forward, or closed, position the side opening 44 is covered and the nozzle mechanism 20 is not exposed to the filling environment, and when the inner body 40 is in a rearward, or open, position the side opening 44 is uncovered and the nozzle mechanism 20 is exposed to the filling environment.

The removal mechanism 18 removes the locking mechanism 28 from the connector 12 to expose the side opening 32 in the fitting 26 for filling, and replaces the locking mechanism 28 once filling is complete. The removal mechanism 18 may be mechanical in nature, and use direct physical contact and/or manipulation, e.g., turning or pushing/pulling, to remove and replace the locking mechanism 28. In the embodiment shown in the figures, for example, the removal mechanism 18 is movable between first forward and rearward positions and includes a plurality of flexible or spring-loaded gripping structures 50, or fingers, that fit over and grip the locking mechanism 28. Additionally or alternatively, the removal mechanism 18 may use vacuum pressure to remove and replace the locking mechanism 28 and/or to retain the locking mechanism 28 while it is removed. Initially, the removal mechanism 18 moves to its forward position and grips the locking mechanism 28, then moves to the rearward position to remove the locking mechanism 28 and allow the nozzle mechanism 20 to interface with the side opening 32 in the fitting 26 during filling, and then moves back to the forward position to replace the locking mechanism 28 once filling is complete, as described above.

The nozzle mechanism 20 delivers the fluid from a fluid reservoir to the connector 12 during the filling process. The nozzle mechanism 20 includes a shaft 52 that is movable between a first, or filling, position in which a forward portion of the shaft 52 extends through the side opening 44 in the outer body 39 of the filling chamber 16 into the filling environment and into the side opening 32 in the fitting 26, and a second, or non-filling, position in which the forward portion of the shaft 52 is blocked from the filling environment by the inner body 40 of the filling chamber 16 in its forward position. As shown, the shaft 52 may intersect the filling chamber 16 angularly, such as, for example, at an angle of approximately between 30 degrees and 60 degrees, or, in one particular embodiment, 45 degrees, relative to the fitting 26.

The sterilization mechanism 22 sterilizes at least a portion of the connector 12 and the filling chamber 16, at the beginning of every fill cycle; conducts a complete sterilization rinse cycle after a pre-set number of fills; and allows for measurable and measured sterilization of all moving components. The sterilization mechanism 22 may use any suitable sterilizing technique, including, for example, the application of hydrogen peroxide to the surfaces to be sterilized. The sterilization mechanism 22 includes a sprayer component 54, an evacuation component 55, and a contact component 56. The sprayer component 54 sprays, or mists, the sterilizing liquid onto one or more of the surfaces to be sterilized, including the surfaces defining the filling environment. Depending on where the sprayer component 54 is located, it may be angled, such as upwardly or downwardly, in order to ensure proper dispersion of the mist throughout the filling environment. The evacuation component 55 evacuates any remaining airborne mist immediately prior to filling. The contact component 56 applies sterilizer directly to certain surfaces to be sterilized, especially portions of the moving parts that may be exposed to a non-sterile environment during the filling process, such as, for example, the side and upper surfaces of the connector 12, the shaft 52 of the nozzle mechanism 20, and a rearward portion of the inner body 40 of the filling chamber 16. The sprayer and contact components 54,56 may draw sterilizing liquid from a reservoir, wherein the sprayer component 54 does so through pumping action and the contact components 56 do so through wicking action. For non-aseptic filling, the sterilization mechanism 22 may be eliminated or replaced with some other appropriate mechanism for conditioning or controlling the filling environment. For example, in one embodiment for non-aseptic filling, the sterilization mechanism is replaced with a cleaning mechanism in which a cleaning fluid is introduced via the sprayer and/or applied via the contact components.

Figures 2, 3, 4, 5, 6, 7:
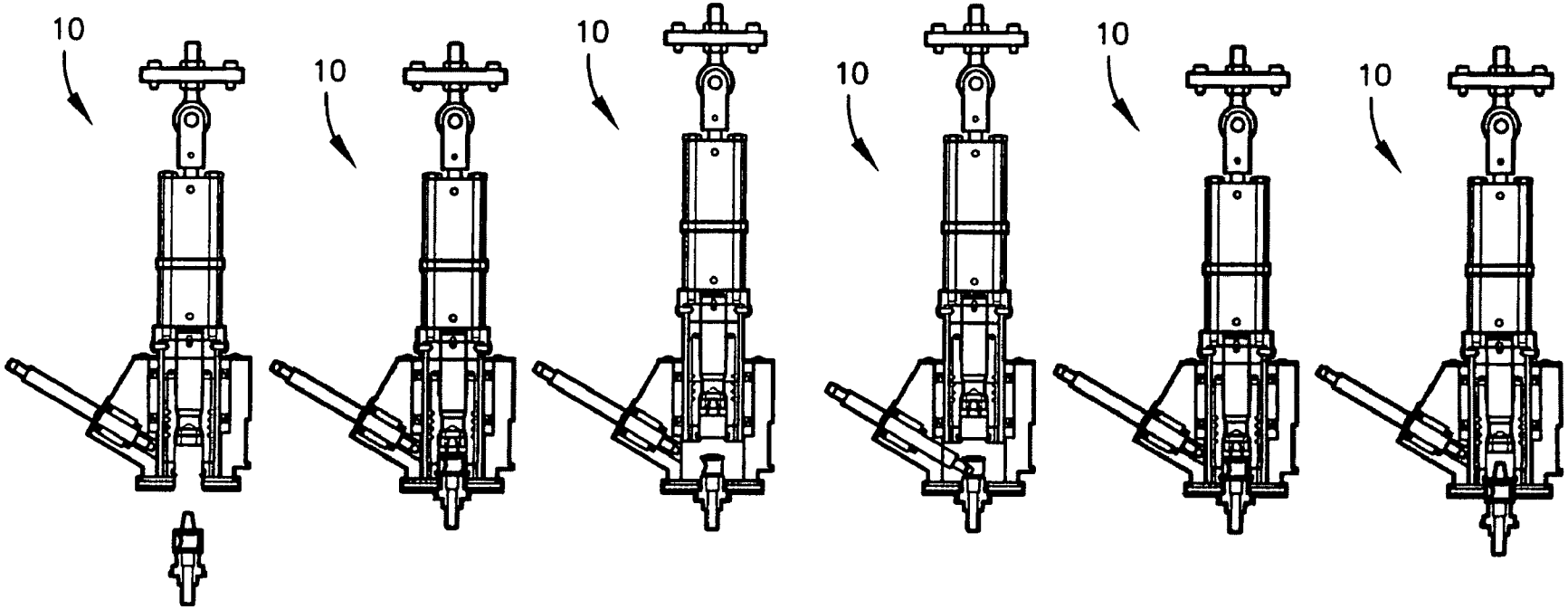
FIG. 2 is a sectional elevation view of the system of FIG. 1 shown in a first stage of operation.
FIG. 3 is a sectional elevation view of the system of FIG. 1 shown in a second stage of operation.
FIG. 4 is a sectional elevation view of the system of FIG. 1 shown in a third stage of operation.
FIG. 5 is a sectional elevation view of the system of FIG. 1 shown in a fourth stage of operation.
FIG. 6 is a sectional elevation view of the system of FIG. 1 shown in a fifth stage of operation.
FIG. 7 is a sectional elevation view of the system of FIG. 1 shown in a sixth stage of operation.

In exemplary use and operation, the system 10 may function substantially as follows, with reference to FIGS. 2-7. Initially, the nozzle mechanism 20 is in the second position, and the inner body structure 40 of the filling chamber 16 is in the forward position, as shown in FIG. 2. At least the locking mechanism 28 and upper fitting portion 26*a* of the fitting 26 of the connector 12 are received within the lower opening 42 of the filling chamber 16, as shown in FIG. 3. In so doing, the contact component 56 of the sterilizing mechanism 22 applies the sterilizing liquid to at least a portion of the connector 12. The spray component 54 of the sterilizing mechanism 22 introduces a spray, or mist, of sterilizing liquid into the filling chamber 16. Shortly thereafter, any of the mist still airborne is evacuated from the filling chamber 16, such as by vacuum suction. Next, the removal mechanism 18 moves to its forward position and grips the locking mechanism 28 of the connector 12. Then, the removal mechanism 18 moves to its rearward position and thereby removes the locking mechanism 28 and exposes the side opening 32 in the fitting 26 of the connector 12, as shown in FIG. 4. At substantially the same time, the inner body 40 of the filling chamber 16 moves to its rearward position, thereby uncovering the side opening 44 in the outer body structure 39 and exposing the nozzle mechanism 20 to the filling environment. Next, the shaft 52 of the nozzle mechanism 20 moves to its first position, and thereby extends through the side opening 44 in the outer body 39 of the filling chamber 16 and into the side opening 32 in the fitting 26 of the connector 12, as shown in FIG. 5. The liquid is then transferred through the shaft 52, into and through the passageway through the fitting 26, and into the container. This movement of the fluid may be accomplished using any suitable mechanism, such as a diaphragm pump or a peristaltic pump. Then, once the container is filled with the fluid, the shaft 52 moves back to its second position, the inner body 40 moves back to its forward position, and the removal mechanism 18 moves back to its forward position and replaces the locking mechanism 28 in the closed position, as described above, as shown in FIGS. 6 and 7. Lastly, the removal mechanism 18 releases the locking mechanism 28 so that the connector 12 can be withdrawn from the filling machine 14 and a new container can be placed in position for filling.

Figure 8:
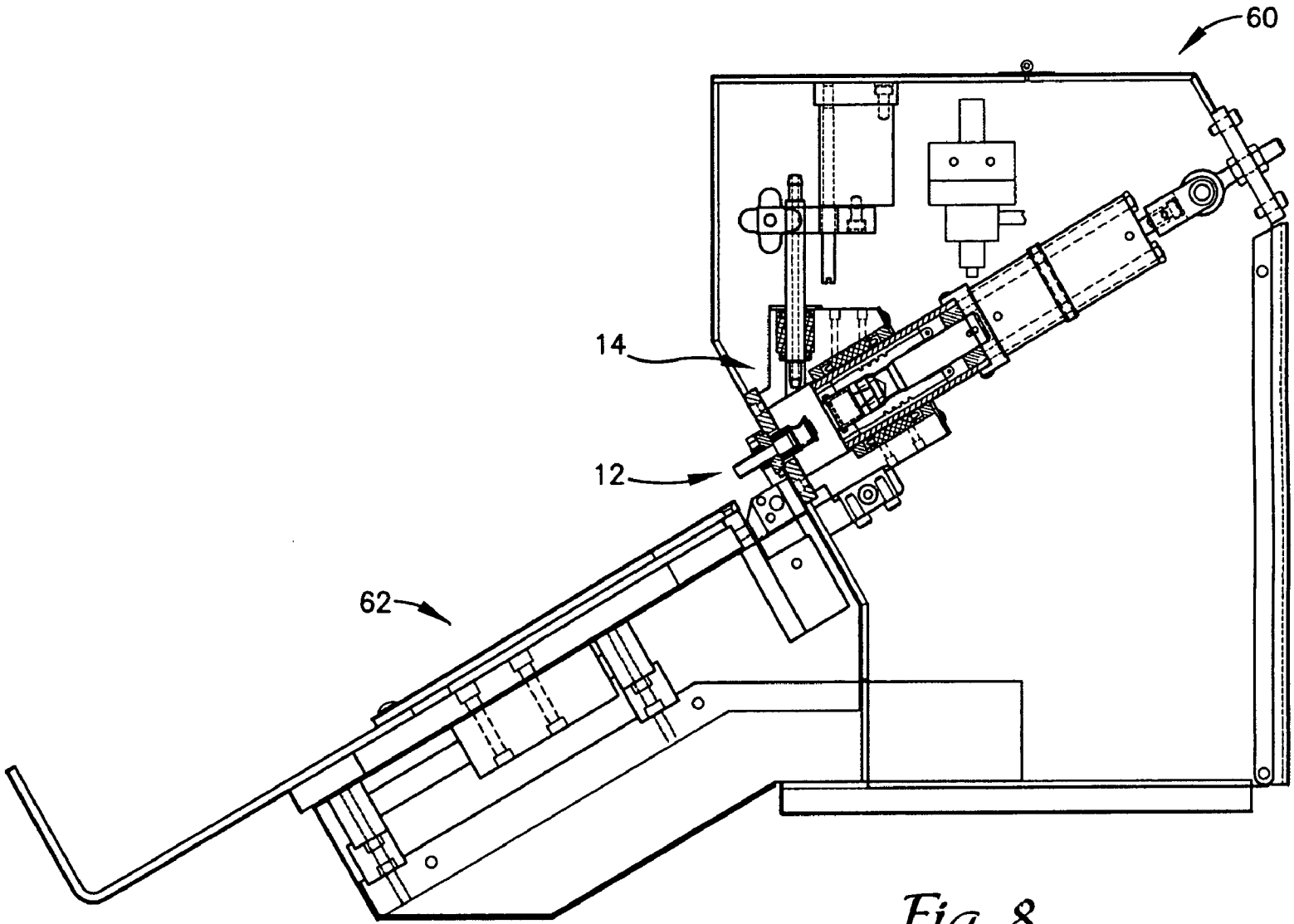
FIG. 8 is a sectional elevation view of the system of FIG. 1 shown in combination with an embodiment of a mounting and support structure.

Referring to FIG. 8, the filling machine 14 is shown mounted on or otherwise combined with a mounting and support structure 60,62. The mounting portion 60 securely receives and maintains the filling machine 14 in an orientation such that the shaft 52 of the nozzle mechanism 20 is maintained substantially vertical in order to control dripping of the fluid therefrom, and the support structure 62 maintains the container in a correspondingly angled orientation. The support portion 62 includes a container-supporting shelf for receiving and retaining the container during the filling process. In one embodiment, the system 10 and mounting and support structure 60,62 together have a benchtop area, or "footprint", of approximately 12 inches by 12 inches.

In one embodiment, multiple instances of the filling machine 10 are coupled with the same fluid reservoir to allow fluid to be transferred therefrom to multiple containers simultaneously.

Referring to FIGS. 12-17, a second embodiment of the system 110 broadly comprises the connector 12 and the filling machine 114, with the filling machine including the filling chamber 116; the removal mechanism 118; and the nozzle mechanism 120. The system 110 is shown in combination with the mounting and support structures 160 and 162, see FIG. 12.

This embodiment does not include an integrated sterilization mechanism. Instead, when aseptic filling is desired, the filling machine 114 is placed within an appropriately controlled environment, such as a laminar flow hood. In at least one implementation, the entire system 110 can be autoclaved or otherwise sterilized before being placed in the hood. As such, the filling chamber 116 of this second embodiment takes the form of a removable shroud 117 operable to prevent inadvertent direct and contaminating contact with the shaft 152 of the nozzle mechanism 120.

Figure 12:
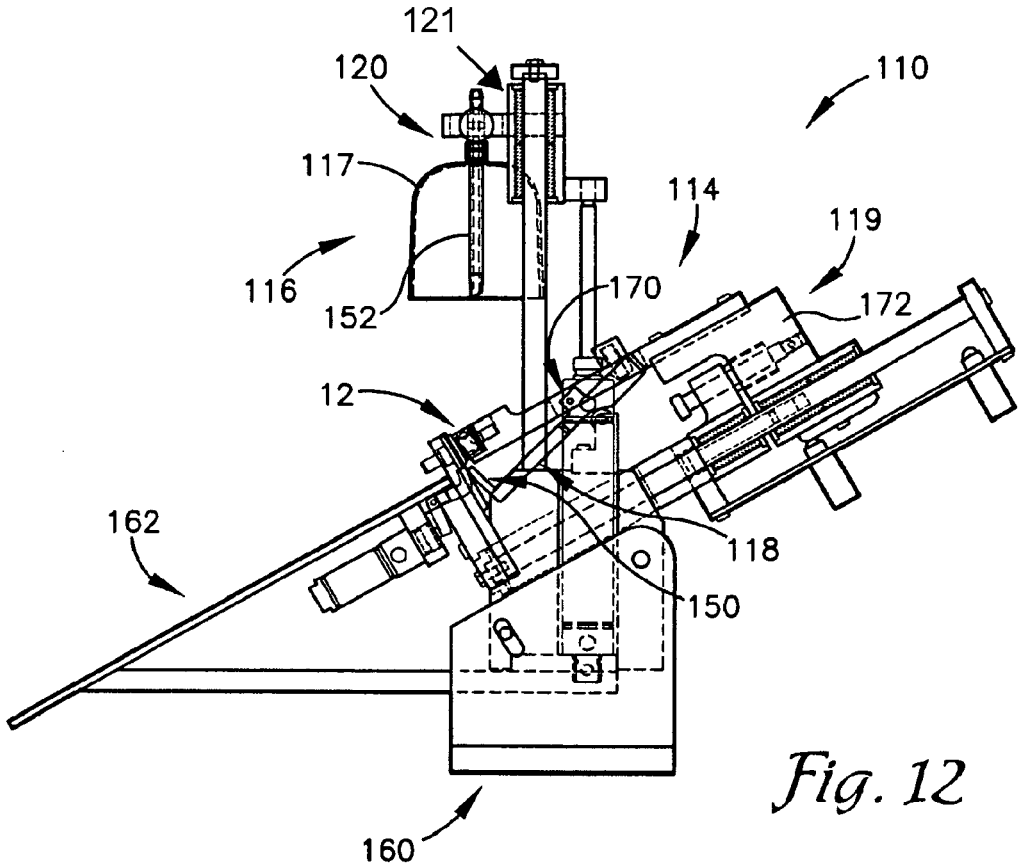
FIG. 12 is a sectional elevation view of a second embodiment of the system of the present invention shown in a first stage of operation.
Figure 13:
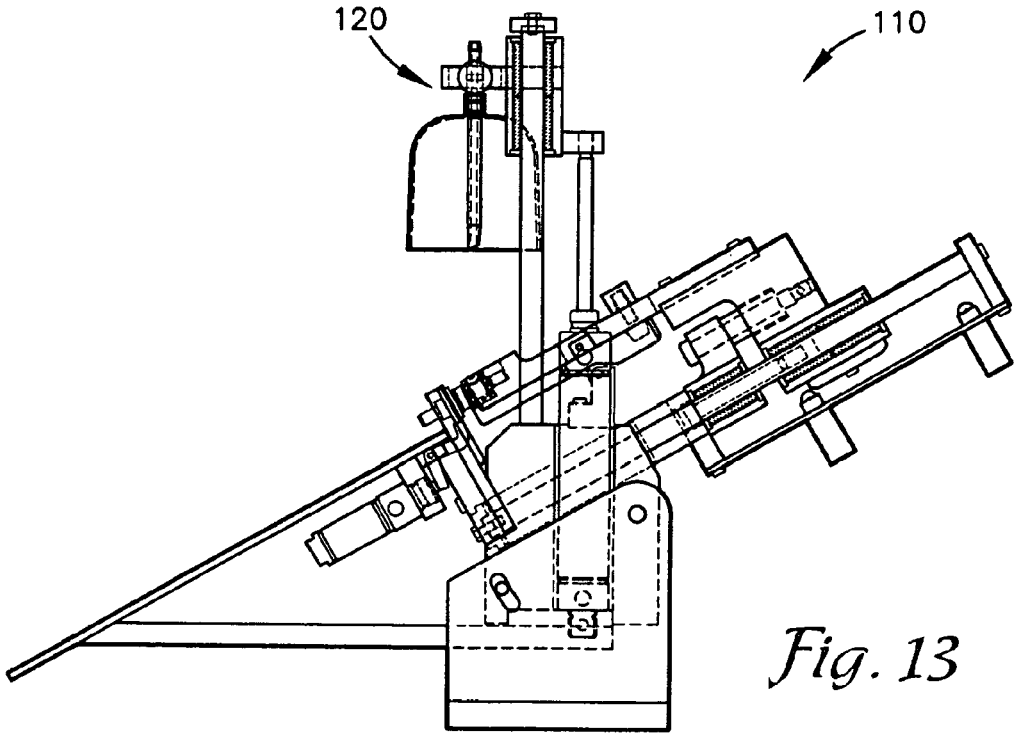
FIG. 13 is a sectional elevation view of the system of FIG. 12 shown in a second stage of operation.
Figure 14:
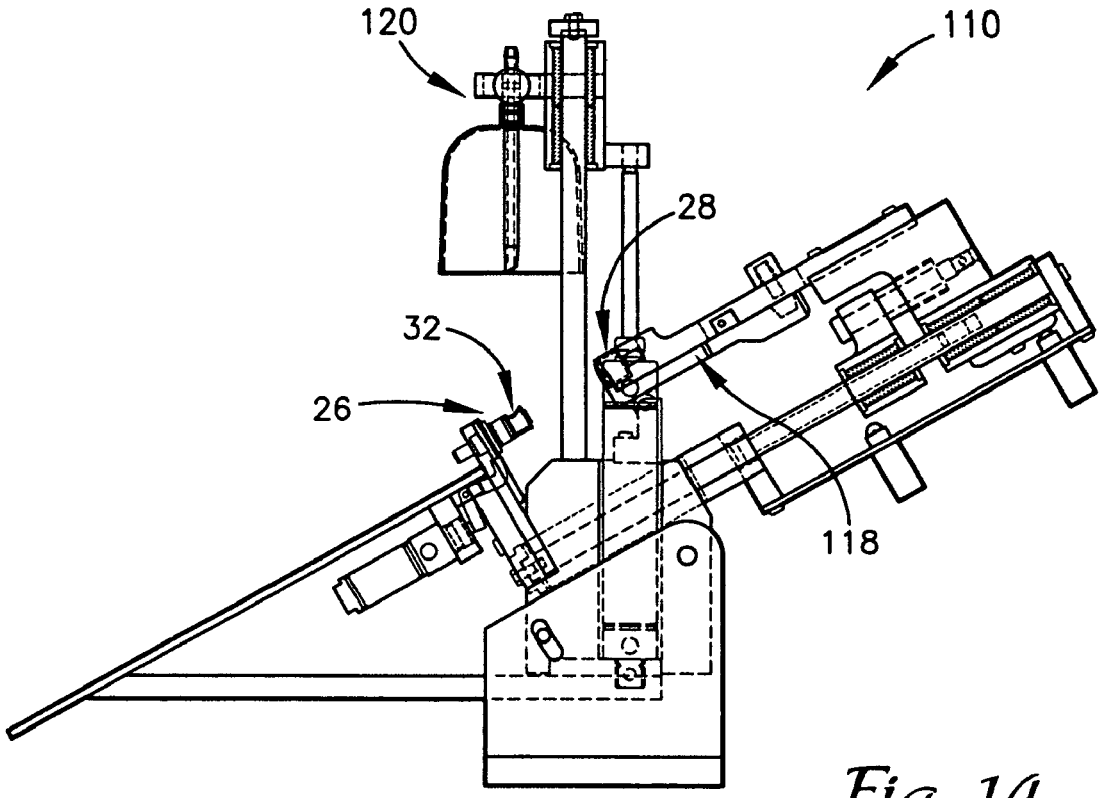
FIG. 14 is a sectional elevation view of the system of FIG. 12 shown in a third stage of operation.

The removal mechanism 118 of this embodiment performs substantially the same function as the removal mechanism 18 discussed above, but in a different manner. In the embodiment shown in the figures, for example, the removal mechanism 118 includes angled fingers 150 for fitting between the locking mechanism 28 and the container, and has two movement profiles. In one embodiment, the angled fingers 150 are angled at approximately 90 degrees relative to the remainder of the removal mechanism 118. The first movement profile involves pivot-type movement in which the angled fingers 150 move from a position substantially adjacent the locking mechanism 28, as shown in FIG. 12, to a position substantially between the locking mechanism 28 and the container, as shown in FIG. 13. The second movement profile involves substantially linear-type movement in which the angled fingers 150 move from a position substantially adjacent the container, as shown in FIG. 13, to a position spaced apart from the container, as shown in FIG. 14, wherein, in moving away from the container, the angled fingers 150 disengage and move the locking mechanism 28 away from the fitting 26 and container as well, thereby exposing the side opening 32 in the fitting 26 for filling. Once filling is complete, the second movement profile is reversed to replace the locking mechanism 28 onto the fitting 26, and then the first movement profile is reversed to reengage the locking mechanism 28 with the fitting 26 and then disengage the removal mechanism 118 from the locking mechanism 28.

Also shown is a pivot and extension/retraction mechanism 119 for substantially automatically accomplishing movement of the removal mechanism 118 along the first and second movement profiles, both forward and reverse. In the embodiment shown in the figures, for example, the pivot and extension/retraction mechanism 119 includes a pivot point and mechanism 170 for accomplishing the first movement profile, and an arm 172 coupled at one end with the removal mechanism 118 and coupled at an opposite end to a source of substantially linear motion which may be, for example, electrical, mechanical, hydraulic, or pneumatic in nature.

The nozzle mechanism 120 of this embodiment performs substantially the same function as the nozzle mechanism 20 discussed above. More specifically, the shaft 152 is movable between a first, or filling, position in which a forward portion of the shaft 152 extends into the side opening 32 in the fitting 26, and a second, or non-filling, position in which the shaft 152 is retracted. As shown, the shaft 52 may intersect the filling chamber 16 angularly, such as, for example, at an angle of approximately between 30 degrees and 60 degrees, or, in one particular embodiment, 45 degrees, relative to the fitting 26. As discussed above, the mounting structure 60 maintains the filling machine 114 in an orientation such that the shaft 152 is maintained substantially vertical in order to control dripping of the fluid therefrom, and the support structure 62 maintains the container in a correspondingly angled orientation.

Also shown is an extension/retraction mechanism 121 for substantially automatically extending and retracting the shaft 152. In the embodiment shown in the figures, for example, the extension/retraction mechanism 121 includes an arm coupled at one end with the shaft 152 and coupled at an opposite end to a source of substantially linear motion which may be, for example, electrical, mechanical, hydraulic, or pneumatic in nature.

In exemplary use and operation, the system 110 may function substantially as follows. Initially, the nozzle mechanism 120 is retracted and the angled fingers 150 of the removal mechanism 118 are substantially adjacent the locking mechanism 28, as shown in FIG. 12. Next, the removal mechanism 118 moves along its first movement profile until the angled fingers move to a position substantially between the locking mechanism 28 and the container, as shown in FIG. 13. Then, the removal mechanism 118 moves along its second movement profile away from the container until the locking mechanism 28 is removed from the fitting 26 and the side opening 32 is exposed for filling, as shown in FIG. 14.

Figure 15:
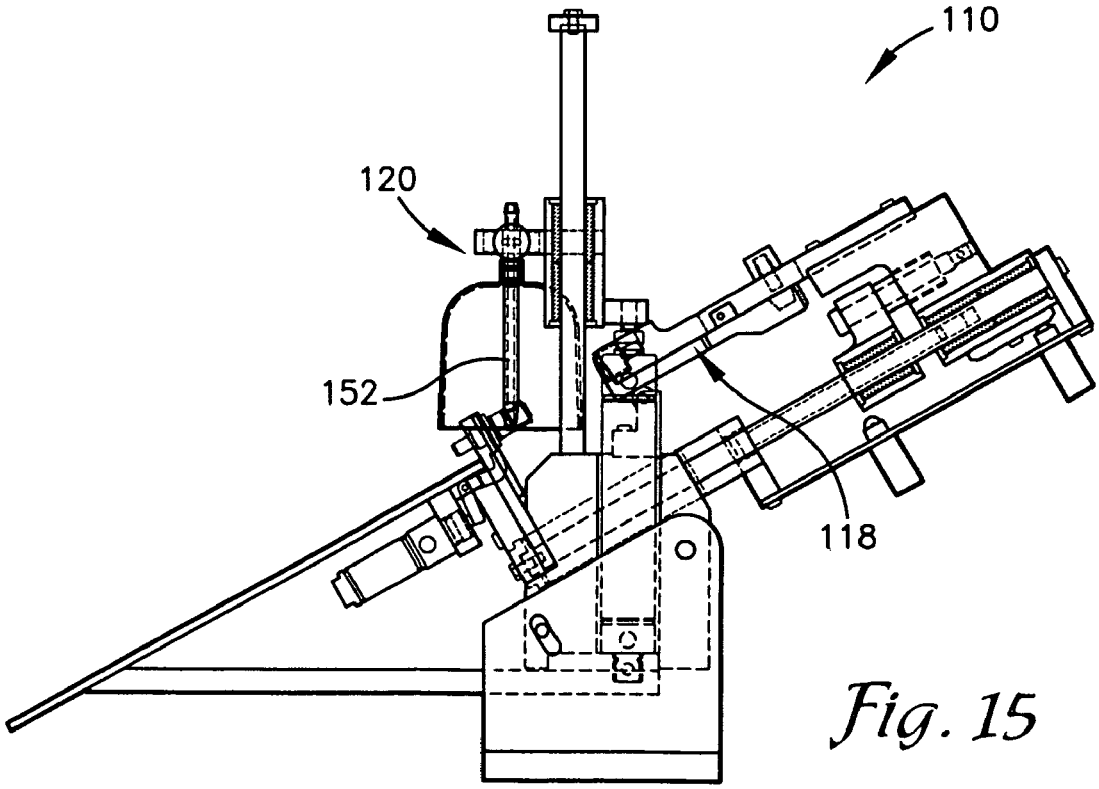
FIG. 15 is a sectional elevation view of the system of FIG. 12 shown in a fourth stage of operation.
Figure 16:
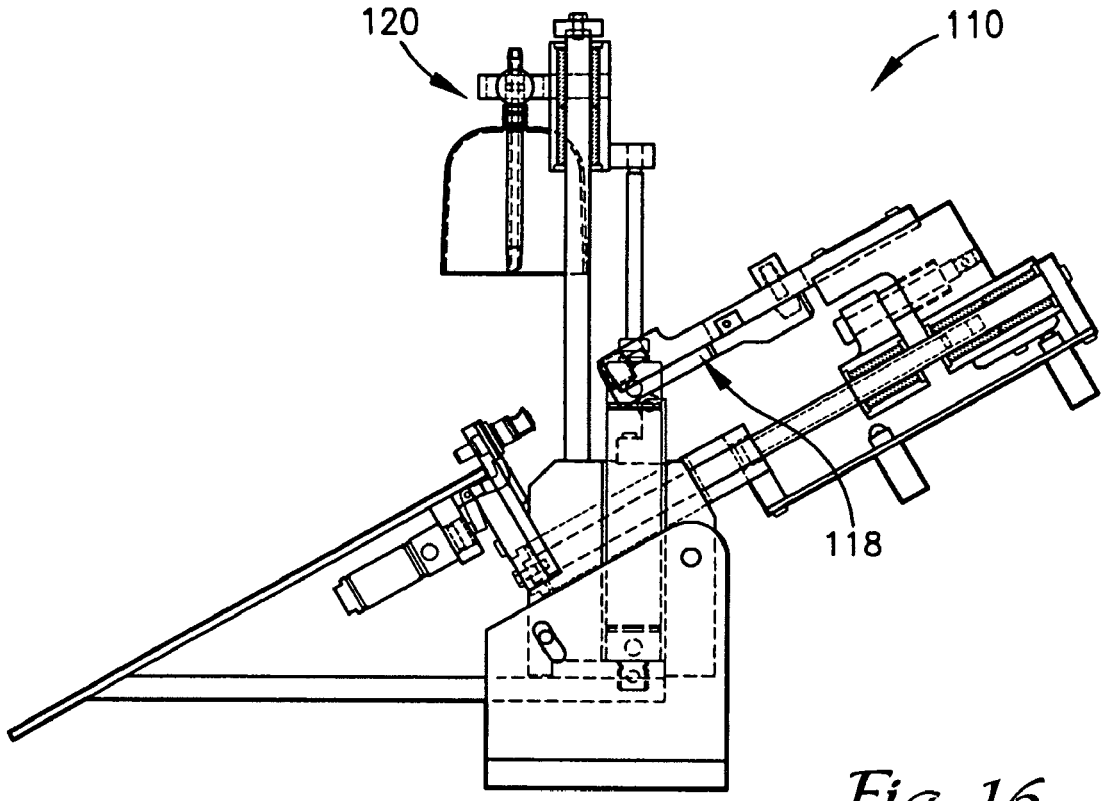
FIG. 16 is a sectional elevation view of the system of FIG. 12 shown in a fifth stage of operation.

Next, the shaft 152 of the nozzle mechanism 120 extends to its first, or filling, position in which the forward portion of the shaft 152 extends into the side opening 32 in the fitting 26, as shown in FIG. 15. The liquid is then transferred through the shaft 152, into and through the passageway through the fitting 26, and into the container. This movement of the fluid may be accomplished using any suitable mechanism, such as a diaphragm pump or a peristaltic pump. Then, once the container is filled with the fluid, the nozzle mechanism 120 is retracted to its second, or non-filling, position, as shown in FIG. 16.

Figure 17:
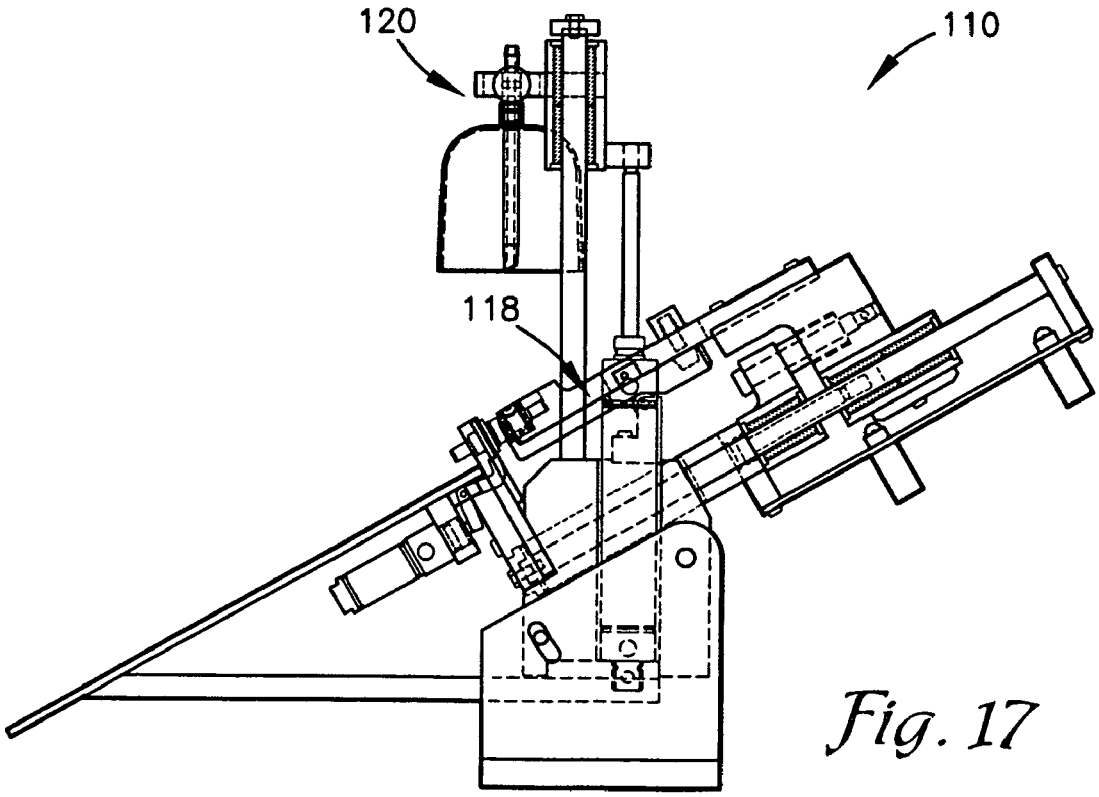
FIG. 17 is a sectional elevation view of the system of FIG. 12 shown in a sixth stage of operation.
Figure 18:
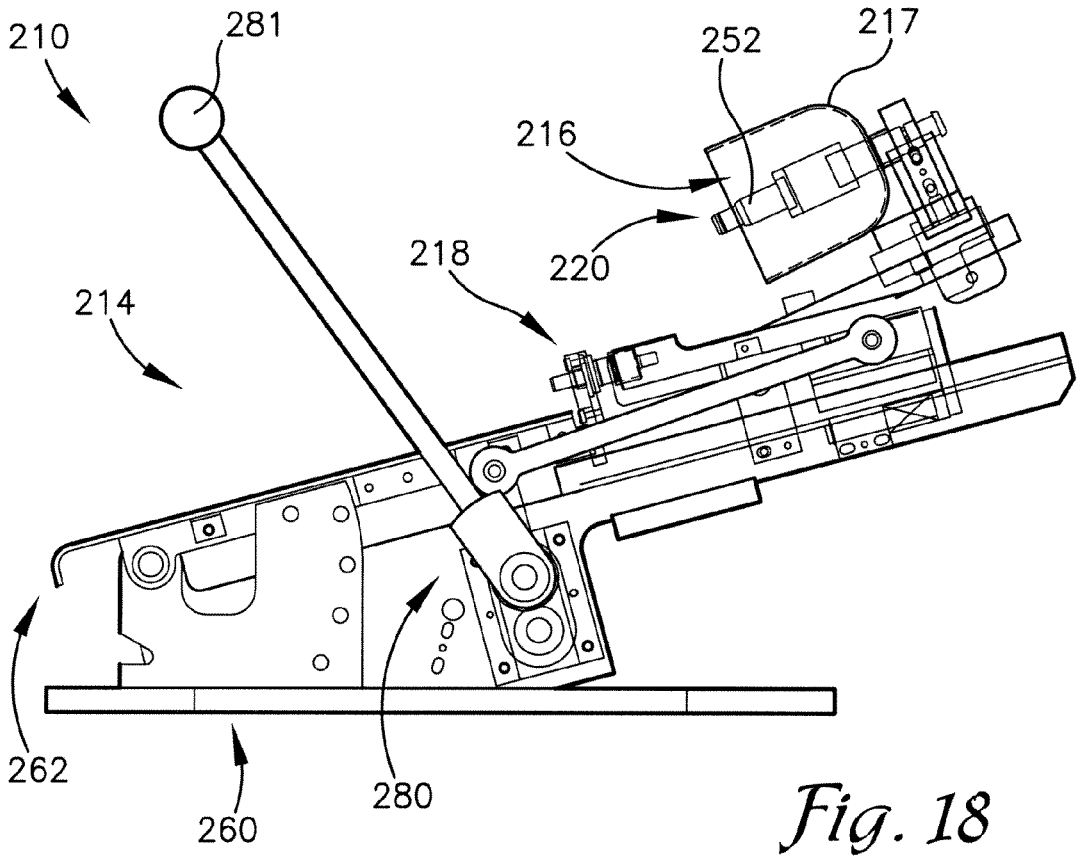
FIG. 18 is a sectional elevation view of a third embodiment of the system of the present invention.

Next, the removal mechanism 118 moves in reverse along its second movement profile to replace the locking mechanism 28 onto the fitting 26, as shown in FIG. 17. Then, the removal mechanism 118 moves in reverse along its first movement profile to disengage the removal mechanism 118 from the locking mechanism 28. Thereafter, the filled container is removed from the filling machine 114 and a new container is positioned for filling.

It is contemplated that, for both the first and second embodiments, the filling operation may be substantially automatically accomplished by a computing device controlling appropriate intermediate structures. For example, the various movements of the various structures, the timing and degree of the sterilization process of the first embodiment, and the timing and amount of the liquid injected into the container via the nozzle mechanism 20,120 may all be accomplished by arms, linkages, motion sources, and valves substantially automatically controlled by the computing device in accordance with pre-established instructions. The pivot and extension/retraction mechanism 119 for the removal mechanism 118, and the extension/retraction mechanism 121 for the nozzle mechanism 120, are examples of such intermediate structures.

Referring to FIGS. 18-26, a third embodiment of the system 210 broadly comprises the connector 212 and the filling machine 214, with the filling machine including the filling chamber 216; the removal mechanism 218; the nozzle mechanism 220; and the mounting and support structures 260,262. The third embodiment may be substantially similar to, or otherwise incorporate particular features of, the first or second embodiments except as follows.

Like the second embodiment, the third embodiment does not include an integrated sterilization mechanism. Instead, when aseptic filling is desired, the filling machine 214 is placed within an appropriately controlled environment, such as a laminar flow hood. In at least one implementation, the entire system 210, or at least a large portion thereof, can be autoclaved or otherwise sterilized before being placed in the hood. As such, the filling chamber 216 of this third embodiment also takes the form of the removable shroud 217 operable to prevent inadvertent direct and contaminating contact with the shaft 252 of the nozzle mechanism 220.

Like the first and second embodiments, the system 210 is compatible with a variety of different metering systems for controlling the amount of fluid transferred to the container, including plumat, paristalic, diaphragm, and PDC massflow metering systems.

Figure 19:
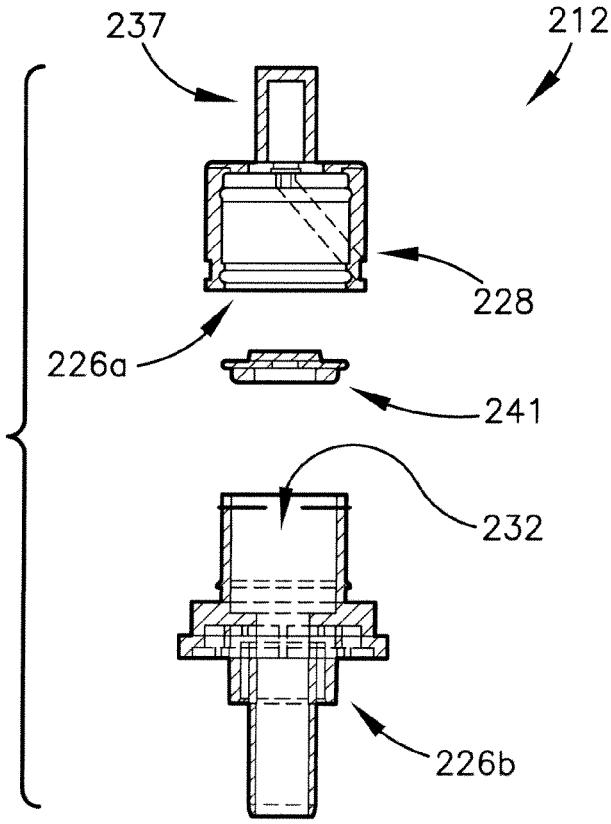
FIG. 19 is a cross-sectional exploded view of a connector component of the system of FIG. 18.
Figure 20:
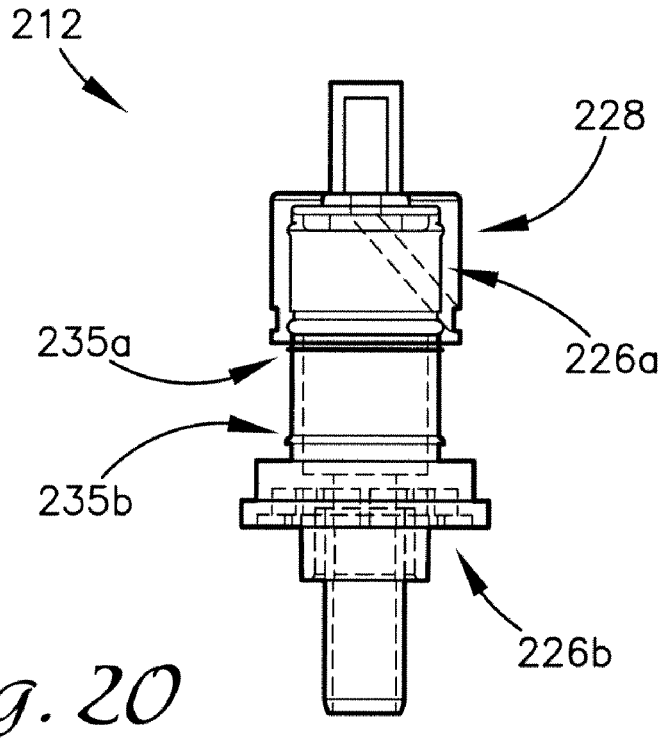
FIG. 20 is a cross-sectional elevation view of the connector component of FIG. 19 shown in a first closed-but-not-locked position.
Figure 21:
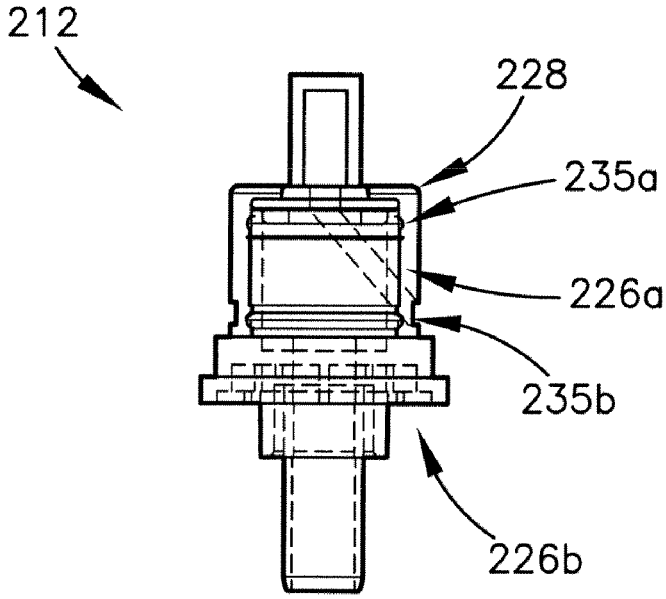
FIG. 21 is a cross-sectional elevation view of the connector component of FIG. 19 shown in a second closed-and-locked position.

Referring particularly to FIGS. 19-21, the connector 212 of this third embodiment is substantially similar to the connector 12 shown in FIGS. 9-11, except that the port 232 is located on a top surface rather than on a side surface of the lower fitting portion 226*b*. More specifically, the connector 212 includes the upper and lower fitting portions 226*a*,226*b*; the locking mechanism 228; the top projection 237; and a septum component 241 which is press-fitted onto or otherwise closes the port 232 once filling is complete. The septum component 241 may be an integral part of the upper fitting portion 226*a*, or may be a separate piece. When it is desired to dispense the fluid from the container, the septum component 241 is punctured to provide a pathway therefor.

As shown in FIG. 20, prior to filling, the upper fitting portion 226*a* and the locking mechanism 228 of the connector 212 are in a closed-but-not-locked position, which is defined by the upper detent 235*a*. Because the connector 212 is closed, i.e., the port 232 is not exposed, the container remains internally sterile; because the upper fitting portion 226*a* and the locking mechanism 228 are not locked onto the lower fitting portion 226*b*, they can be removed by the removal mechanism 218 for filling. As shown in FIG. 21, after filling, the upper fitting portion 226*a* and the locking mechanism 228 are in a closed-and-locked position, which is defined by the lower detent 235*b*. Because the connector 212 is closed and locked, the fluid cannot be easily accessed except by removing, such as by cutting, the top projection 237 and puncturing the septum component 241.

The removal mechanism 218 is operable to remove the upper fitting portion 226*a* and the locking mechanism 228 to expose the port 232, and moves along a first substantially linear path. The nozzle mechanism 220 is operable to direct the fluid into the container through the open port 232, and moves along a second substantially linear path which is oriented angularly with respect to the first substantially linear path.

The support structure 262 supports the container, wherein the support structure 262 is movable between a first position in which the container, specifically the upper fitting portion 226*a* and the locking mechanism 228 are aligned with first substantially linear path of the removal mechanism 218, and a second position in which the container, specifically the port 232, is aligned with the second substantially linear path of the nozzle mechanism 220.

An actuator mechanism 280 causes the support structure 262 to move between the first and second positions. In one implementation, the actuator mechanism 280 includes a handle 281 and an assemblage of cams, gears, or other mechanical, hydraulic, pneumatic, or electrical components sufficient to achieve the movement and other functionality described herein. In one implementation, a first movement of the handle 281 causes the removal mechanism 218 to remove the upper fitting portion 226*a* and the locking mechanism 228 from the connector 212; the support structure 262 to move to the second position; and the nozzle mechanism 220 to move along the second substantially linear path into close proximity with the port 232 of the lower fitting portion 226*b*. The fluid can then be transferred to the container via the nozzle mechanism 220 and open port 232. A second movement of the handle 281 causes the nozzle mechanism 220 to move along the second substantially linear path away from the port 232; the support structure 262 to move back to the first position; and the removal mechanism 218 to replace the upper fitting portion 226*a* and the locking mechanism 228. As mentioned, in one implementation the upper fitting portion 226*a* and the locking mechanism 228 are replaced on the lower fitting portion 226*b* in the closed-and-locked position.

In the second embodiment, the container is stationary, the removal mechanism 118 moves linearly along a path which coincides with a longitudinal axis of the connector 112, and the nozzle mechanism 120 moves linearly along a path which is angled relative to the longitudinal axis of the connector 112. Because the port 32 is located on the side of the lower fitting portion 126*b*, the removal and nozzle mechanisms 118,120 can interact with the stationary connector 112 without interfering with each other. By contrast, in the third embodiment the port 232 is on the top of the lower fitting portion 226*b*, so the container is moved between alignment with the removal mechanism 218 and alignment with the nozzle mechanism 220 to avoid interference between the two mechanisms.

Figure 22:
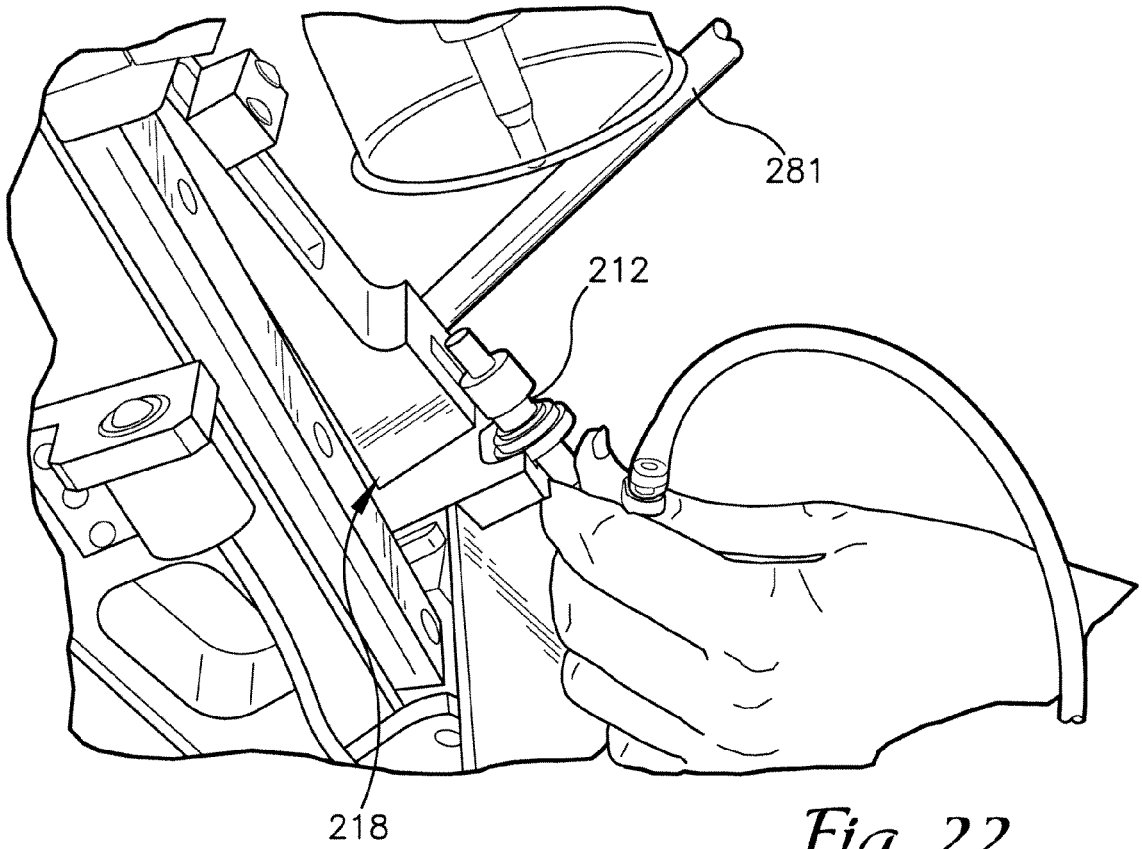
FIG. 22 is a sectional elevation view of the system of FIG. 18 shown in a first stage of operation.
Figure 23:
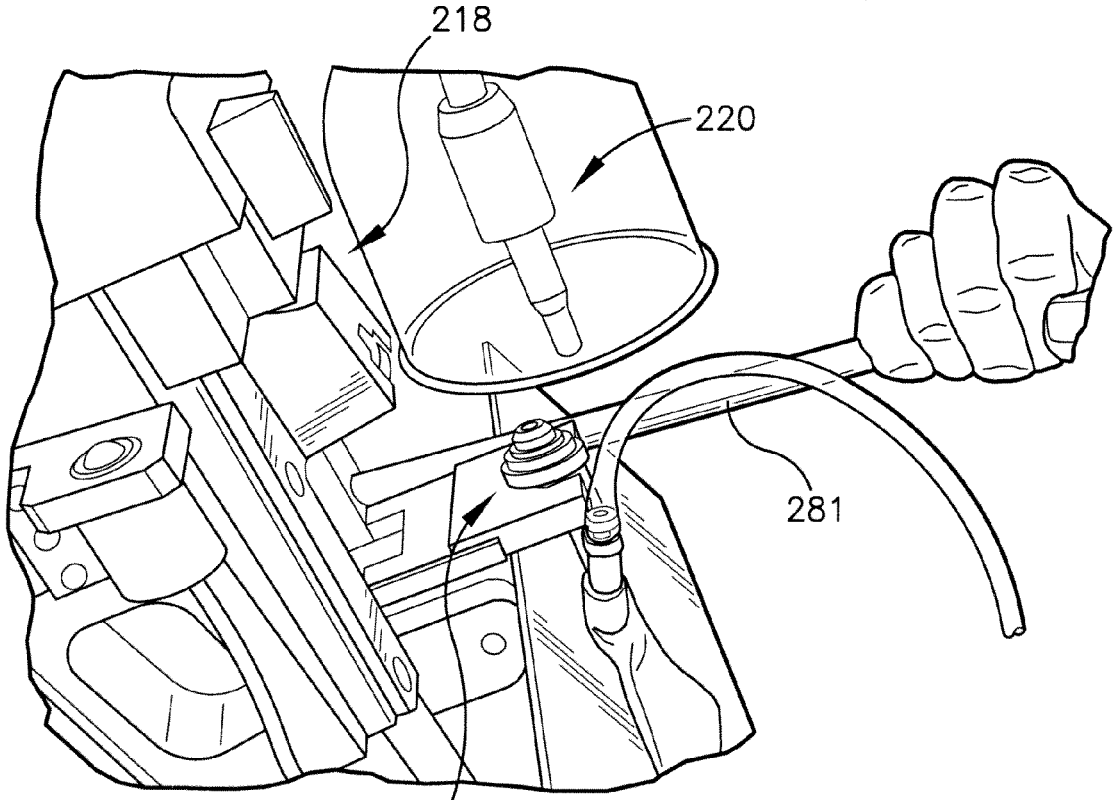
FIG. 23 is a sectional elevation view of the system of FIG. 18 shown in a second stage of operation.
Figure 24:
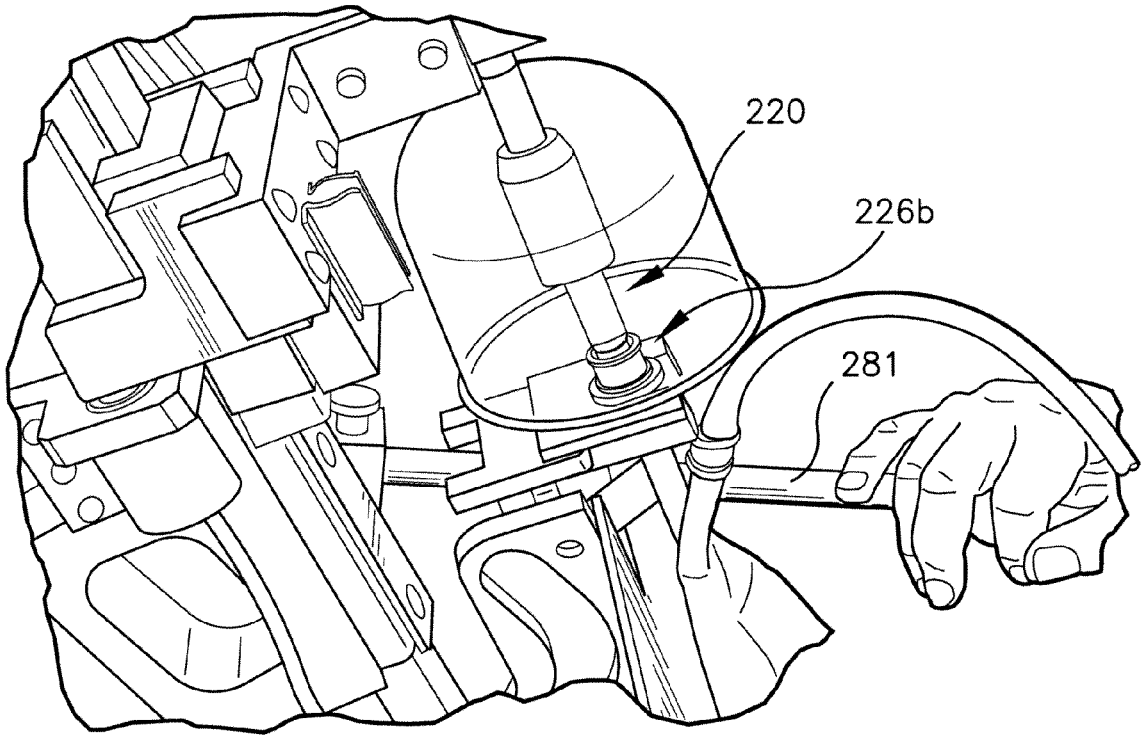
FIG. 24 is a sectional elevation view of the system of FIG. 18 shown in a third stage of operation.
Figure 25:
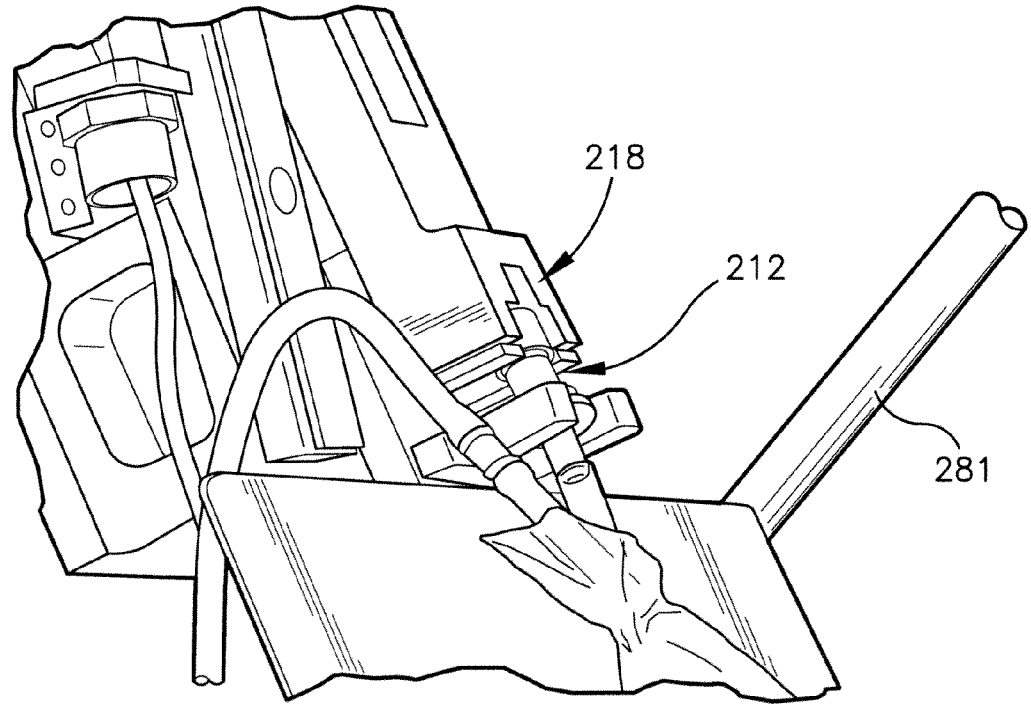
FIG. 25 is a sectional elevation view of the system of FIG. 18 shown in a fourth stage of operation.
Figure 26:
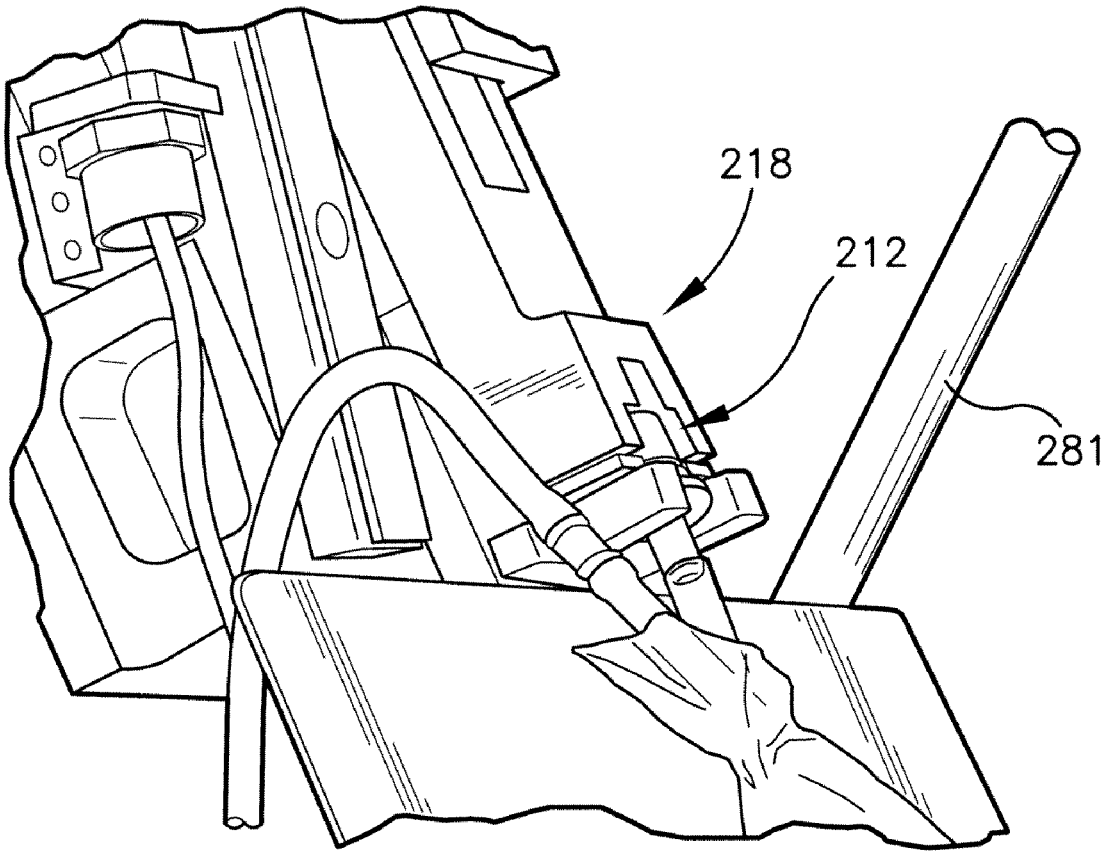
FIG. 26 is a sectional elevation view of the system of FIG. 18 shown in a fifth stage of operation.

In exemplary use and operation, the system 210 may function substantially as follows. Referring particularly to FIGS. 22-26, with the connector 212 attached to the container (which is, in this example, a bag), an operator places the container on the support structure 262, with the upper fitting portion 226*a* and the locking mechanism 228 received by the removal mechanism 218, as shown in FIG. 22. The operator then actuates the handle 281, thereby causing the removal mechanism to move away from the container along the first substantially linear path and, in so doing, to substantially automatically remove the upper fitting portion 226*a* and the locking mechanism 228, which was in the closed-but-not-locked position, from the connector 212; move the container so that the port 232 aligns with the nozzle mechanism 220; and move the nozzle 252 along the second substantially linear pathway into close proximity with the port 232, as shown in FIGS. 23 and 24. The fluid is then transferred to the container via the nozzle mechanism 220 and the port 232. When the desired amount of fluid has been dispensed into the container, the operator returns the handle 281 to its original position, thereby causing the system to substantially automatically move the nozzle mechanism 220 back along the second linear pathway; move the container into alignment with the removal mechanism 218; and replace the upper fitting portion 226*a* and the locking mechanism 228 by pushing them onto the lower fitting portion 226*b* into the closed-and-locked position, as shown in FIGS. 25 and 26. The filled bag can then be removed and the next bag can be positioned for filling. When it is desired to access the fluid, the projection 237 is removed and the septum component 241 of the upper fitting portion 226*a* is punctured.

From the foregoing discussion, it will be appreciated by one with ordinary skill in the art that the present invention provides a number of advantages over the prior art, including, for example, that close cooperation between the nozzle mechanism and connector allows for a more controlled transfer of fluid to the container, which eliminates waste and the need for a separate cleaning step prior to completion. Furthermore, in the first embodiment, the connector and filling chamber are sterilized at the beginning of every fill cycle, there is a complete sterilization rinse cycle after a pre-set number of fills, and measurable and measured sterilization of all moving components is allowed for. Additionally, the second and third embodiments allow for efficient aseptic filling with relatively non-complex systems. For these and other reasons, the present invention allows for more quickly and efficiently filling containers.

Although the invention has been disclosed with reference to various particular embodiments, it is understood that equivalents may be employed and substitutions made herein without departing from the scope of the invention as recited in the claims.

Having thus described the preferred embodiment of the invention, what is claimed as new and desired to be protected by Letters Patent includes the following:

The invention claimed is:

1. A system for filling a container with a fluid, wherein the container is provided with an upper fitting portion and a lower fitting portion, the system comprising:

a removal mechanism operable to remove the upper fitting portion from the lower fitting portion, wherein the removal mechanism moves along a first substantially linear path;

a nozzle mechanism operable to direct the fluid into the container through the lower fitting portion, wherein the nozzle mechanism moves along a second substantially linear path which is oriented angularly with respect to the first substantially linear path;

a support structure operable to support the container, wherein the support structure is movable between a first position in which the container is aligned with the first substantially linear path of the removal mechanism and a second position in which the container is aligned with the second substantially linear path of the nozzle mechanism; and an actuator mechanism operable to cause the support structure to move between the first and second positions, wherein the actuator mechanism is a handle, and a first movement of the handle causes the removal mechanism to remove the upper fitting portion from the lower fitting portion, the support structure to move to the second position, and the nozzle mechanism to move along the second substantially linear path into close proximity with the lower fitting portion; and a second movement of the handle causes the nozzle mechanism to move along the second substantially linear path away from the lower fitting portion, the support structure to move to the first position, and the removal mechanism to replace the upper fitting portion onto the lower fitting portion.

2. A system for filling a container with a fluid, wherein the container is provided with an upper fitting portion and a lower fitting portion, the system comprising:

a removal mechanism operable to remove the upper fitting portion from the lower fitting portion, wherein the removal mechanism moves along a first substantially linear path;

a nozzle mechanism operable to direct the fluid into the container through the lower fitting portion, wherein the nozzle mechanism moves along a second substantially linear path which is oriented angularly with respect to the first substantially linear path;

a support structure operable to support the container, wherein the support structure is movable between a first position in which the container is aligned with the first substantially linear path of the removal mechanism and a second position in which the container is aligned with the second substantially linear path of the nozzle mechanism and an actuator mechanism operable to cause the support structure to move between the first and second positions, wherein the upper fitting portion is initially in a closed but not locked position on the lower fitting portion, in which the upper fitting portion is in a higher position on the lower fitting portion, and the removal mechanism replaces the upper fitting portion onto the lower fitting portion in a closed and locked position in which the upper fitting portion is in a lower position on the lower fitting portion.

3. The system as set forth in claim 2, wherein the higher position is defined by a first detent mechanism, and the lower position is defined by a second detent mechanism.

4. A system comprising:

a container having a connector including an upper fitting portion and a lower fitting portion, the lower fitting portion having a top surface and a port provided in the top surface;

a removal mechanism operable to remove the upper fitting portion from the lower fitting portion to expose the port, wherein the removal mechanism moves along a first substantially linear path;

a nozzle mechanism operable to direct the fluid into the container through the port, wherein the nozzle mechanism moves along a second substantially linear path which is oriented angularly with respect to the first substantially linear path;

a support structure operable to support the container, wherein the support structure is movable between a first position in which the upper fitting portion is oriented with the first substantially linear path of the removal mechanism and a second position in which the lower fitting portion is oriented with the second substantially linear path of the nozzle mechanism; and an actuator mechanism operable to cause the support structure to move between the first and second positions, wherein the actuator mechanism is a handle, and a first movement of the handle causes the removal mechanism to remove the upper fitting portion from the lower fitting portion, the support structure to move to the second position, and the nozzle mechanism to move along the second substantially linear path into close proximity with the lower fitting portion; and a second movement of the handle causes the nozzle mechanism to move along the second substantially linear path away from the lower fitting portion, the support structure to move to the first position, and the removal mechanism to replace the upper fitting portion onto the lower fitting portion.

5. A system comprising:

a container having a connector including an upper fitting portion and a lower fitting portion, the lower fitting portion having a top surface and a port provided in the top surface;

a removal mechanism operable to remove the upper fitting portion from the lower fitting portion to expose the port, wherein the removal mechanism moves along a first substantially linear path;

a nozzle mechanism operable to direct the fluid into the container through the port, wherein the nozzle mechanism moves along a second substantially linear path which is oriented angularly with respect to the first substantially linear path;

a support structure operable to support the container, wherein the support structure is movable between a first position in which the upper fitting portion is oriented with the first substantially linear path of the removal mechanism and a second position in which the lower fitting portion is oriented with the second substantially linear path of the nozzle mechanism; and an actuator mechanism operable to cause the support structure to move between the first and second positions, wherein the upper fitting portion is initially in a closed but not locked position in which the upper fitting portion is in a higher position on the lower fitting portion, and the removal mechanism replaces the upper fitting portion onto the lower fitting portion in a closed and locked position in which the upper fitting portion is in a lower position on the lower fitting portion.

6. The system as set forth in claim 5, wherein the higher position is defined by a first detent mechanism, and the lower position is defined by a second detent mechanism.

7. The system as set forth in claim 4, wherein the connector further includes a septum component which is fitted over the port and puncturable to access the fluid within the filled container.

8. The system as set forth in claim 4, wherein the connector further includes a locking mechanism positioned over the upper fitting portion.

9. A system for filling a container with a fluid, wherein the container is provided with a connector including an upper fitting portion and a lower fitting portion, the system comprising:

a removal mechanism operable to remove the upper fitting portion from the lower fitting portion;

a nozzle mechanism operable to direct the fluid into the container through the lower fitting portion, wherein the nozzle mechanism is spaced apart from and oriented angularly relative to the removal mechanism;

a support structure operable to support the container, wherein the support structure is movable between a first position in which the container is aligned with the removal mechanism and a second position in which the container is aligned with the nozzle mechanism; and an actuator mechanism operable to cause the support structure to move between the first and second positions, wherein the actuator mechanism is a handle, and a first movement of the handle causes the removal mechanism to remove the upper fitting portion from the lower fitting portion, the support structure to move to the second position, and the nozzle mechanism to move along the second substantially linear path into close proximity with the lower fitting portion; and a second movement of the handle causes the nozzle mechanism to move along the second substantially linear path away from the lower fitting portion, the support structure to move to the first position, and the removal mechanism to replace the upper fitting portion onto the lower fitting portion.

* * * * *